US007306439B2

(12) United States Patent
Unami et al.

(10) Patent No.: US 7,306,439 B2
(45) Date of Patent: Dec. 11, 2007

(54) ORBITING SCROLL IN A SCROLL FLUID MACHINE

(75) Inventors: Atsushi Unami, Fujisawa (JP); Tamotsu Fujioka, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/234,642

(22) Filed: Sep. 23, 2005

(65) Prior Publication Data

US 2006/0067847 A1 Mar. 30, 2006

(30) Foreign Application Priority Data

Sep. 29, 2004 (JP) ..... 2004-283581

(51) Int. Cl.
*F01C 1/04* (2006.01)
*F01C 1/07* (2006.01)

(52) U.S. Cl. ..... 418/55.3; 418/60

(58) Field of Classification Search ..... 418/55.1, 418/55.3, 60; 464/102
See application file for complete search history.

(56) References Cited

U.S. PATENT DOCUMENTS 4,192,152 A * 3/1980 Armstrong et al. ..... 62/402
4,950,138 A * 8/1990 Spinnler ..... 418/55.3
5,755,564 A * 5/1998 Machida et al. ..... 418/55.2
6,106,247 A * 8/2000 Wood ..... 417/410.5
6,179,590 B1 * 1/2001 Honma et al. ..... 418/55.1
6,450,791 B1 * 9/2002 Kawabata et al. ..... 418/55.1

FOREIGN PATENT DOCUMENTS

EP 545187 A1 * 6/1993
JP 05248377 A * 9/1993
JP 06213174 A * 8/1994

OTHER PUBLICATIONS

Eugene A. Avallone and Theodore Baumeister III, Mark's Standard Handbook for Mechanical Engineers—10th Edition, Copyright 1996, Publisher: McGraw-Hill, pp. 5-14-5-20.*

* cited by examiner

*Primary Examiner*—Thomas Denion
*Assistant Examiner*—Mary A Davis
(74) *Attorney, Agent, or Firm*—Ostrolenk, Faber, Gerb & Soffen, LLP

(57) ABSTRACT

A scroll fluid machine includes an orbiting scroll which has an orbiting end plate. The orbiting end plate has a plurality of extensions on the outer circumference. Each of the extensions has a boss in which a self-rotation-preventing eccentric shaft is pivotally supported. The extension has an easily-deformable portion to keep exact positional relationship between the extensions or to the center of the orbiting end plate of the extension.

4 Claims, 3 Drawing Sheets

ORBITING SCROLL IN A SCROLL FLUID MACHINE

BACKGROUND OF THE INVENTION

The present invention relates to an orbiting scroll in a scroll fluid machine in which a stationary wrap of a stationary scroll engages with an orbiting wrap of an orbiting scroll pivotally mounted to an eccentric shaft, the orbiting scroll being eccentrically revolved to allow a gas to be compressed toward the center or to be decompressed radially outwards.

In the present invention, a scroll fluid machine includes a scroll compressor, a scroll vacuum pump, a scroll expander and a scroll blower.

BACKGROUND OF THE INVENTION

Figure 1:
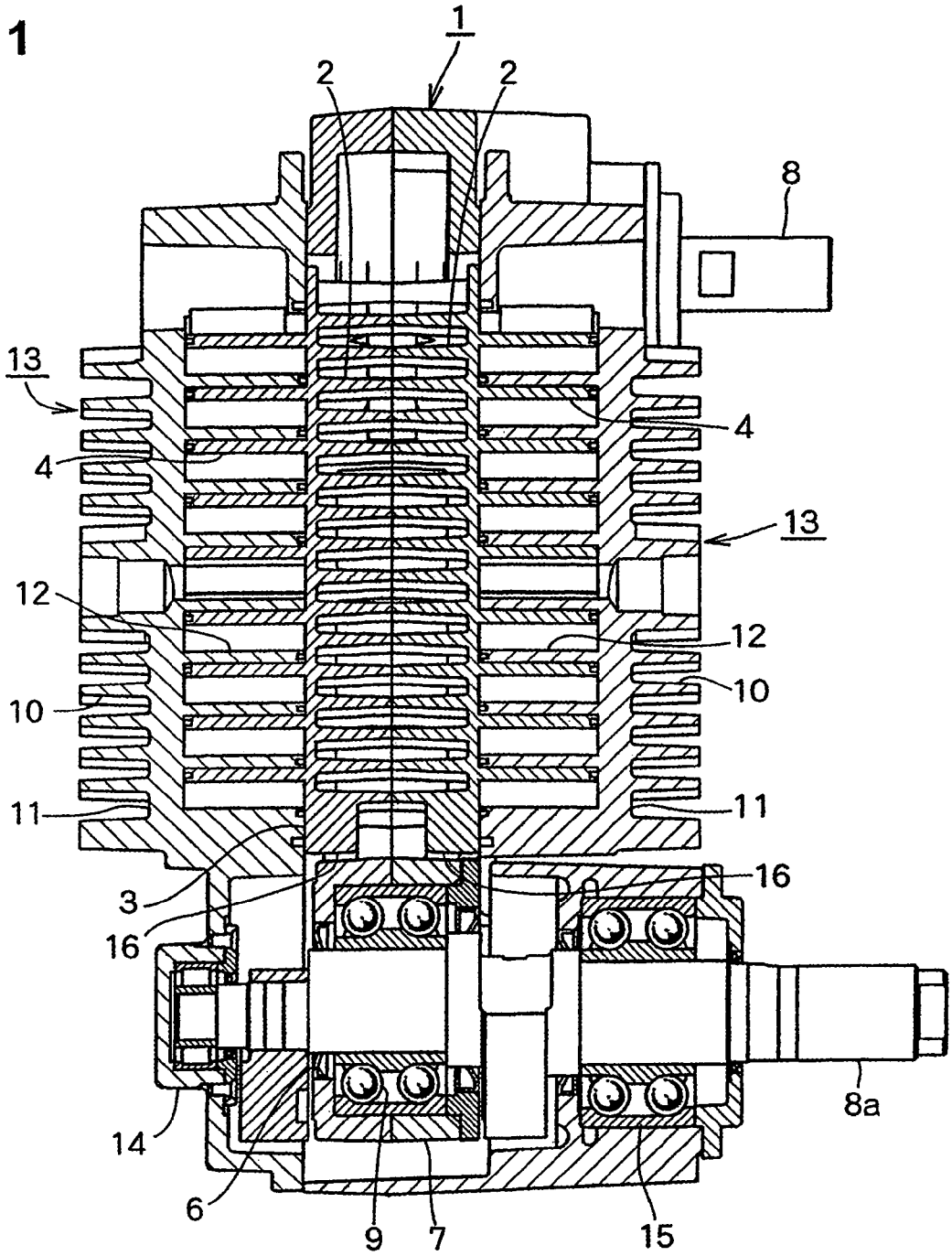
FIG. 1 is a vertical sectional side view of a scroll fluid machine having an embodiment of an orbiting scroll according to the present invention.
Figure 2:
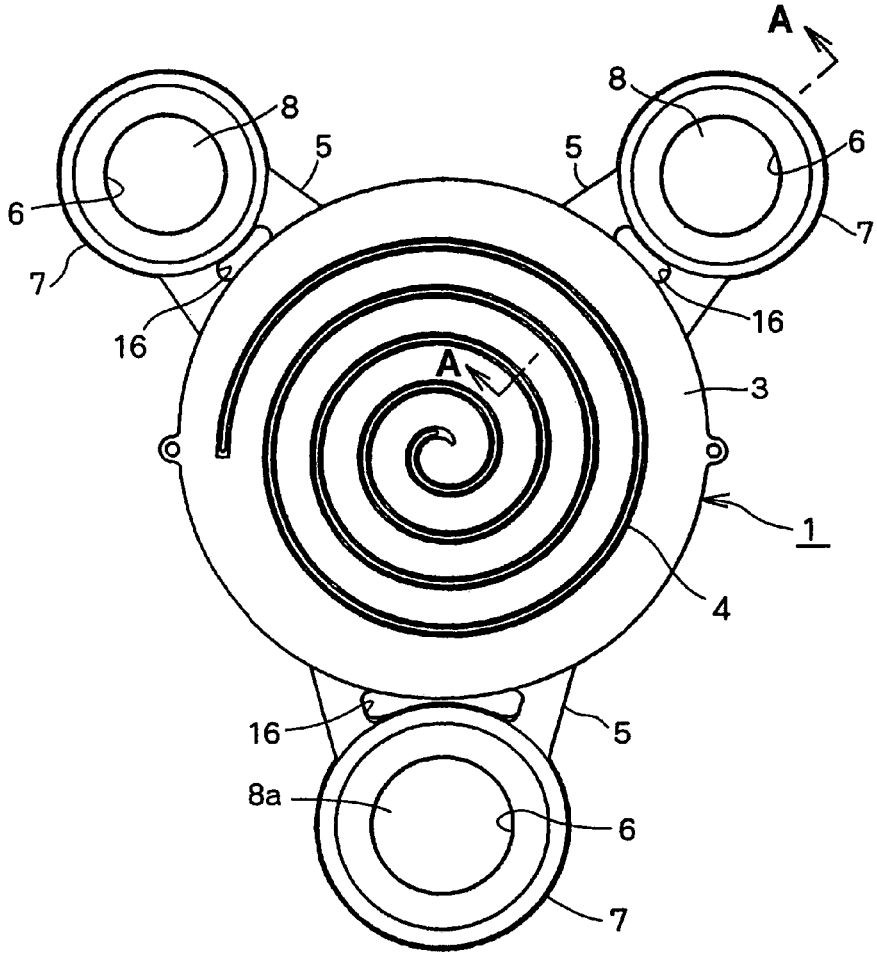
FIG. 2 is a front view of the orbiting scroll.

FIGS. 1 and 2 show a scroll compressor as one example of a scroll fluid machine, including an orbiting scroll.

An orbiting end plate 3 of an orbiting scroll 1 has a plurality of cooling fins 2 on the inner surface, and an orbiting wrap 4 on the outer surface. A plurality of extensions 5, such as two or three, is provided on the outer circumference of the orbiting end plate 3.

At the end of the extension 5, there is provided a boss 7 having an axial hole 6 perpendicular to the surface of the orbiting end plate 3. A crank-pin type self-rotation-preventing eccentric shaft 8,8*a* engages in the axial hole 6 via a ball-bearing 9.

The lower self-rotation-preventing eccentric shaft 8*a* is driven by a suitable power.

The orbiting scroll 1 comprises two halves fastened to each other, but does not relate to the present invention. Its illustration and description are omitted.

The front and rear surfaces of the orbiting scroll 1 engage on stationary scrolls 13, 13 each having a stationary wrap 12 on a stationary end plate 11. The orbiting wrap 4 engages with the stationary wrap 12 to form crescent sealed chambers.

The each end of the self-rotation-preventing eccentric shaft 8 projecting from the boss 7 is pivotally connected to bearings 14, 15 of the stationary end plate 11.

By rotating the lower self-rotation-preventing eccentric shaft 8*a* by a power, the orbiting scroll 1 is eccentrically revolved between the two stationary scrolls 13 and 13, so that volume in the sealed chamber gradually reduces toward the center or gradually increases radially outward to allow fluid sucked on the outer circumference to be compressed toward the center or to allow fluid sucked at the center to be decompressed and discharged from the outer circumference.

However, depending on changes in surrounding temperature and conditions of use, it is difficult to keep exact positional relationship of the three self-rotation-preventing eccentric shafts 8,8*a* and distance or inclination between them and the center of the orbiting scroll 1 as originally designed.

In many cases, they are caused by local wear of the bearing for the self-rotation-preventing eccentric shaft not to result in uniformity in load and side pressure to the boss of the self-rotation-preventing eccentric shaft to develop local wear and local load. Thus, performance and durability decrease and noise occurs.

SUMMARY OF THE INVENTION

In view of the disadvantages, it is an object of the invention to provide an orbiting scroll to keep positional relationship to a boss to improve performance and durability even if relative distance between centers of self-rotation-preventing eccentric shafts and/or distance between the center of the orbiting scroll and the centers of the self-rotation-preventing eccentric shafts changes.

DETAILED DESCRIPTION OF PREFERRED EMBODIMENTS

In FIG. 1, an elongate hole 16 is formed in the extension 5 to constitute a easily-deformable portion.

Even if distance between the axial holes 6 and 6 or distance between the axial hole 6 and the center of the orbiting scroll 3 is different from originally designed value or even if the distance becomes different from designed value owing to use or variation in surrounding temperature, the self-rotation-preventing eccentric shafts 8,8*a* are suitably supported by each of the bosses 7 thereby preventing wear from being developed or noise or heat from occurring.

Figure 3:
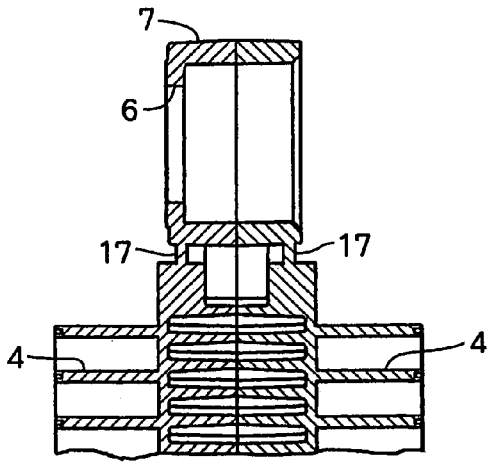
FIG. 3 is a sectional view of another embodiment of an easily-deformable portion taken along the line A-A in FIG. 2.
Figure 4:
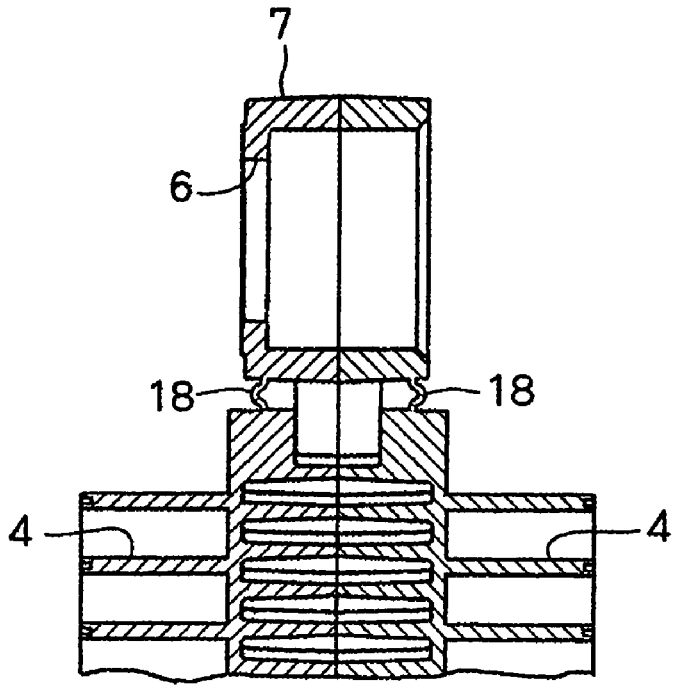
FIG. 4 is a sectional view of further embodiment of the easily-deformable portion, similar to FIG. 3.
Figure 5:
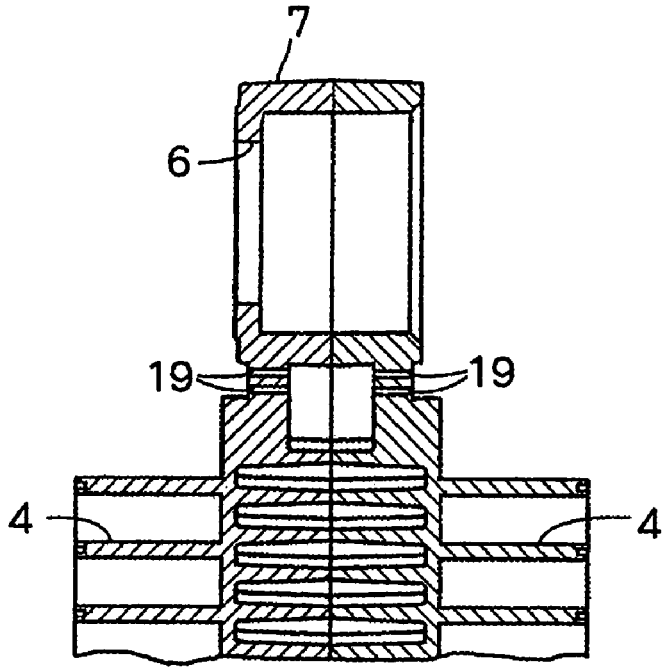
FIG. 5 is a sectional view of yet another embodiment of the easily-deformable portion, similar to FIG. 3.

FIGS. 3 to 5 show different embodiments of the easily-deformable portion, such as a thin portion 17 in FIG. 3, a flexible portion 18 in FIG. 4 and a plurality of small holes 19.

The foregoing merely relates to embodiments of the invention. Various changes and modifications may be made by a person skilled in the art without departing from the scope of claims wherein:

What is claimed is:

1. An orbiting scroll in a scroll fluid machine, comprising:

an orbiting end plate having an orbiting wrap and an outer peripheral circumference;

a plurality of self-rotation-preventing eccentric shafts; and a plurality of extensions extending radially from the outer peripheral circumference of the orbiting end plate, each of the plurality of extensions having a boss in which one of the eccentric shafts is pivotally supported and a deformable thin portion extending radially from the outer peripheral circumference of the orbiting end plate to the boss and connecting the boss to the orbiting end plate to keep exact positional relationship of the eccentric shafts with respect to one another or a center of the orbiting end plate.

2. An orbiting scroll of claim 1 wherein one of said plurality of self-rotation-preventing eccentric shafts is driven by a power source.

3. An orbiting scroll of claim 1 wherein the deformable thin portion is flexible.

4. An orbiting scroll of claim 1 wherein the deformable thin portion comprises a plurality of small holes.

* * * * *